US006716025B1

(12) United States Patent
Wu

(10) Patent No.: US 6,716,025 B1
(45) Date of Patent: Apr. 6, 2004

(54) GAS VOLUME CONTROL DEVICE FOR GAS BURNERS

(76) Inventor: Sen-Yu Wu, No. 582-2, Dong-Guan Rd., Dong-Shih Town, Taichung Hsien (TW)

( * ) Notice: Subject to any disclaimer, the term of this patent is extended or adjusted under 35 U.S.C. 154(b) by 0 days.

(21) Appl. No.: 10/291,434

(22) Filed: Nov. 12, 2002

(51) Int. Cl.[7] ..... F23Q 7/12; F24C 5/20

(52) U.S. Cl. ..... 431/255; 431/12; 126/39 E

(58) Field of Search ..... 431/255, 12, 130, 431/132; 126/39 E

(56) References Cited

U.S. PATENT DOCUMENTS 3,436,165 A * 4/1969 Gehrke ..... 431/256
5,375,585 A * 12/1994 Home ..... 126/39 E
6,192,913 B1 * 2/2001 Willey et al. ..... 137/66
6,322,352 B1 * 11/2001 Zink ..... 431/27
2002/0094498 A1 * 7/2002 Rodriguez-Rodriguez et al. ..... 431/18

* cited by examiner

*Primary Examiner*—Alfred Basichas
(74) *Attorney, Agent, or Firm*—Rosenberg, Klein & Lee

(57) ABSTRACT

A gas burner includes a casing having a chamber and a valve is received in the chamber and biased by a spring. An operation shaft is rotatably inserted in the casing and operatively connected to an ignition device. An inlet tube and an outlet tube are respectively connected to the casing and communicate with the chamber. A receiving recess is defined in the casing and located perpendicular to an axis of the inlet tube. An opening is defined in an outside of the casing so that an adjusting screw is rotatably received in the receiving recess. A first passage is defined in communication between the inlet tube and the receiving recess, a second passage defined in communication with the receiving recess, and a third passage defined in communication between the first passage and the second passage. The adjusting screw is extended in a position that is in communication with the first passage and the second passage. The volume of gas is controlled to be entered in the chamber and the outlet tube by rotating the adjusting screw.

2 Claims, 4 Drawing Sheets

GAS VOLUME CONTROL DEVICE FOR GAS BURNERS

FIELD OF THE INVENTION

The present invention relates to a gas volume control device for a gas burner and includes a bolt rotatably received in the casing of the burner and controlling communication between a passage, an inlet and an outlet so that the volume of the gas entering the outlet can be micro-adjusted.

BACKGROUND OF THE INVENTION

A conventional burner is shown in FIG. 1 and generally includes a casing 11 with a chamber 100 and an inlet tube 10 is connected to the casing 11 and communicates with the chamber 100. An outlet tube 101 is connected to the casing 11 and communicates with the chamber 100 so that gas may enter the chamber 100 via the inlet tube 10 and come out from the outlet tube 101 to be burned. A valve 13 is received in the chamber 100 and biased by a spring 130, a passage 131 is defined through the valve 13 so as to allow the gas to flow. An adjusting screw 14 is threadedly engaged with the inner threads 121 in the path of the control shaft 12. The adjusting screw 14 can be rotated by a screw driver and extended into the valve 13 so that the volume of the gas can be controlled. Nevertheless, the flame of the burner is difficult to be controlled because the volume of the gas can only be controlled by using the screw driver and this takes time and inconvenient.

FIG. 2 shows an improved conventional burner which includes a casing 20 having an inlet tube 22, an outlet tube, a valve 21 biased by a spring 210 and received in the chamber in the casing 20, and an ignition device 24 which can be operated by rotating a shaft 23. Although the burner has an ignition device 24 which allows the user to easily ignite the gas, the volume of the gas is not able to be controlled.

The present invention intends to provide a gas volume control device for a burner wherein the control device is connected to a side of the casing and easily to be operated for the users.

SUMMARY OF THE INVENTION

In accordance with one aspect of the present invention, there is provided a gas burner which includes a casing having a chamber and a valve is received in the chamber and biased by a spring. An operation shaft is rotatably inserted in the casing and operatively connected to an ignition device. An orifice is defined through a wall of the valve and communicates between the inlet tube and the chamber. An inlet tube and an outlet tube are respectively connected to the casing and communicate with the chamber.

A receiving recess is defined in the casing and located perpendicular to an axis of the inlet tube. An opening is defined through an outside of the casing so as to receive an adjusting screw therein. A first passage is defined in communication between the inlet tube and the receiving recess. A second passage is defined in communication with the receiving recess. A third passage is defined in communication between the first passage and the second passage.

The adjusting screw is extended in a position that is in communication with the first passage and the second passage so that the gas volume can be controlled by rotating the screw.

The primary object of the present invention is to provide a gas volume control device which is easily to be made in the conventional gas burner without too much change in structure.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
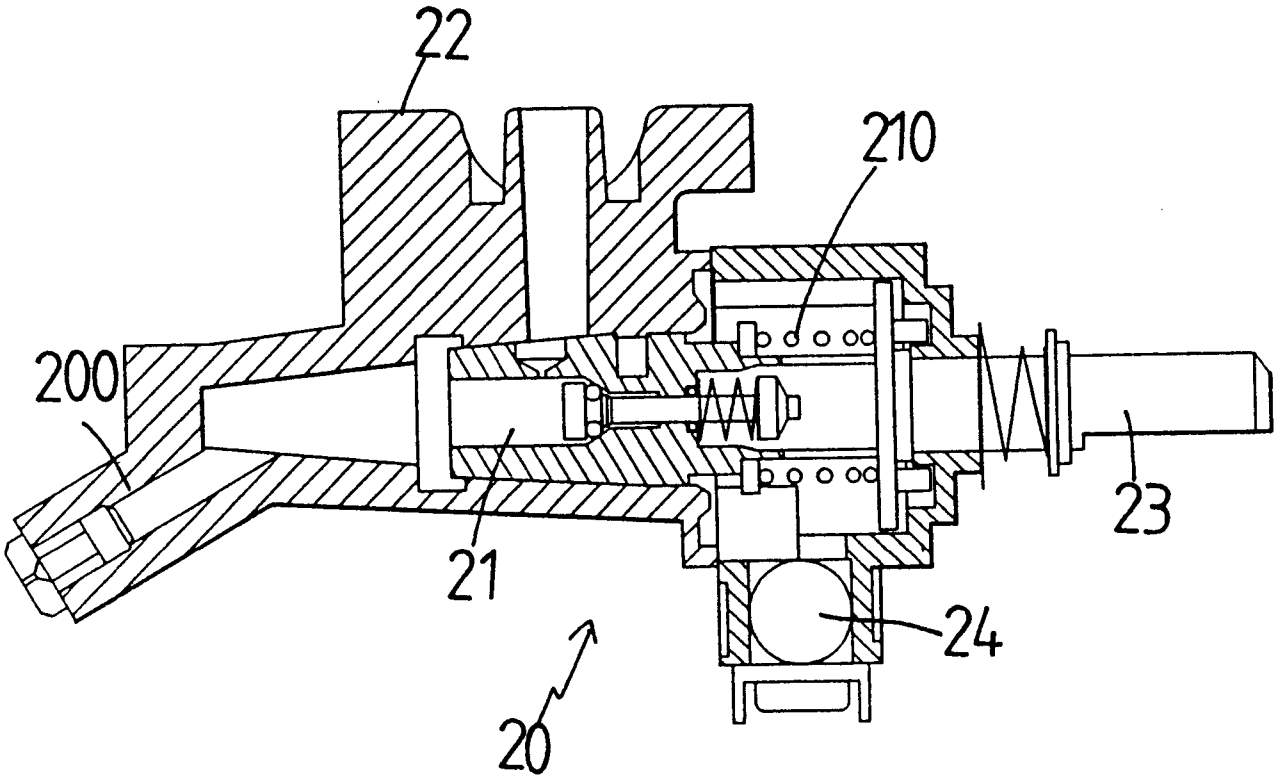
FIG. 1 PRIOR ART
FIG. 1 is a cross sectional view to show a conventional gas burner.
Figure 2:
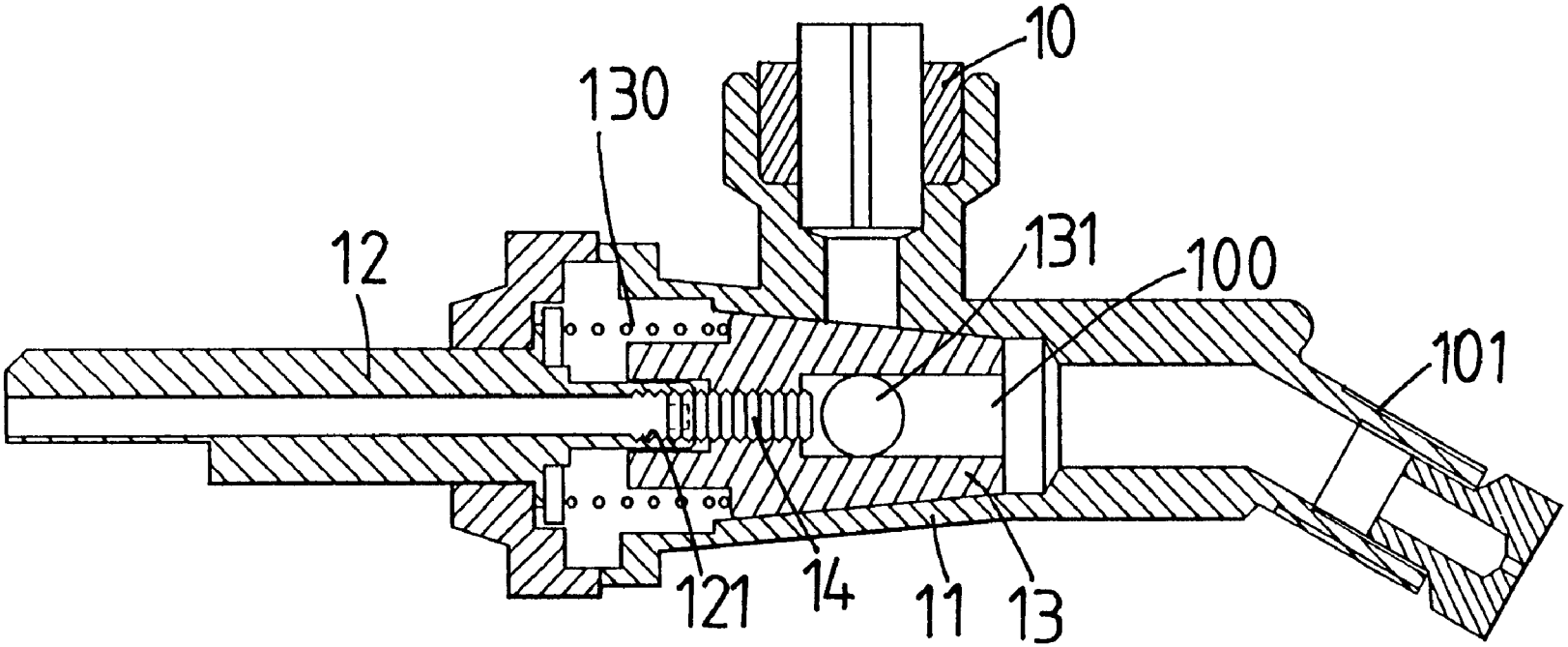
FIG. 2 PRIOR ART
FIG. 2 is a cross sectional view to show another conventional gas burner.
Figure 3:
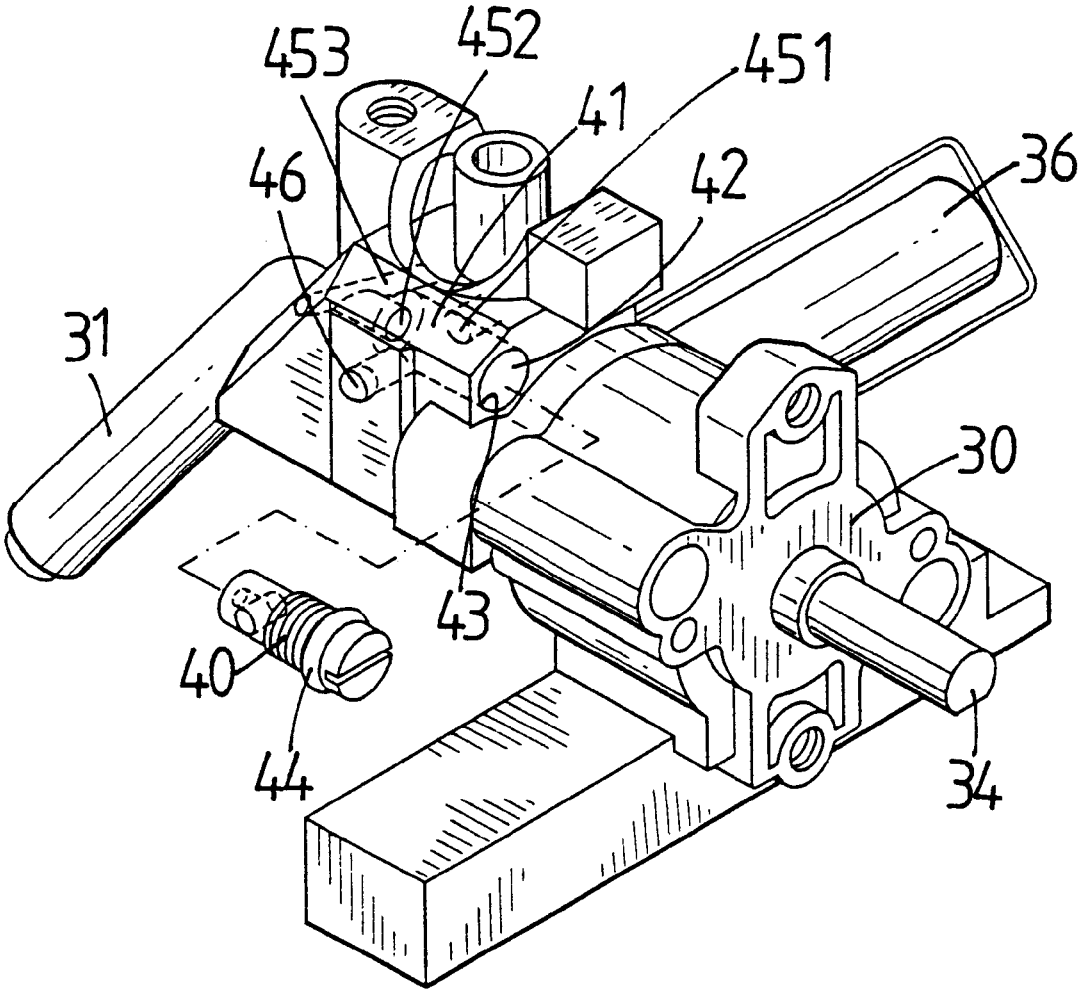
FIG. 3 is a perspective view to show the burner having the gas volume control device of the present invention.
Figure 4:
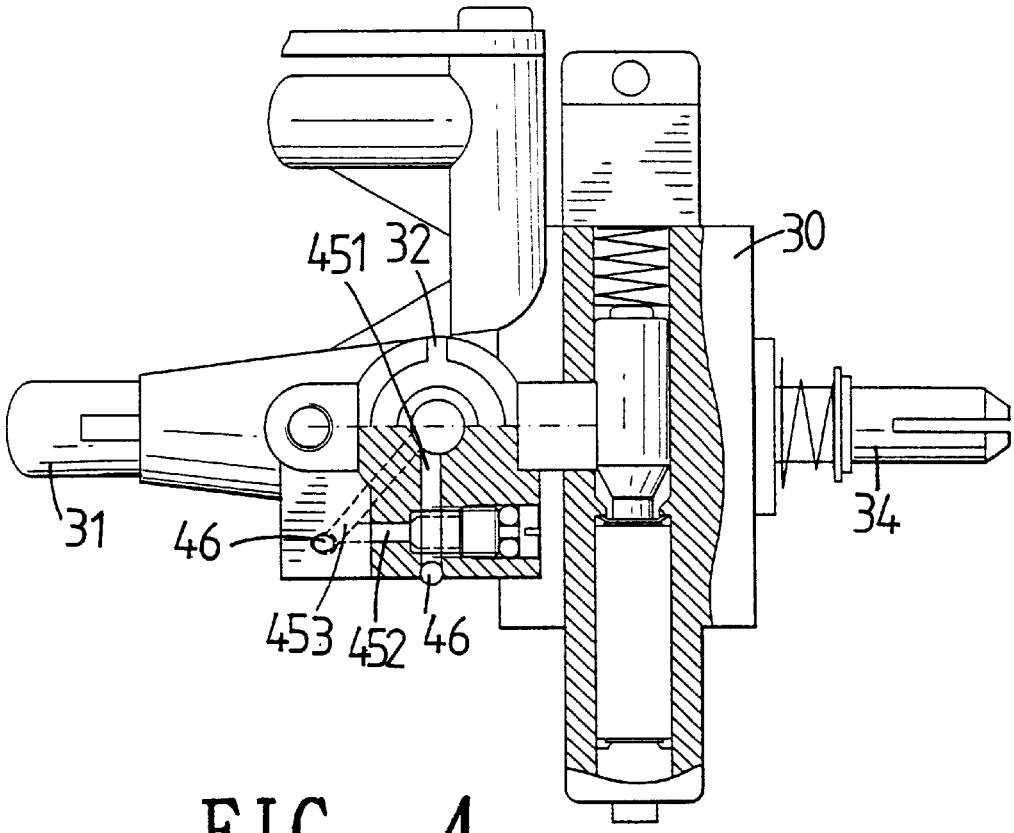
FIG. 4 is a top cross sectional view to show the gas burner and the passages in the casing of the gas burner.
Figure 5:
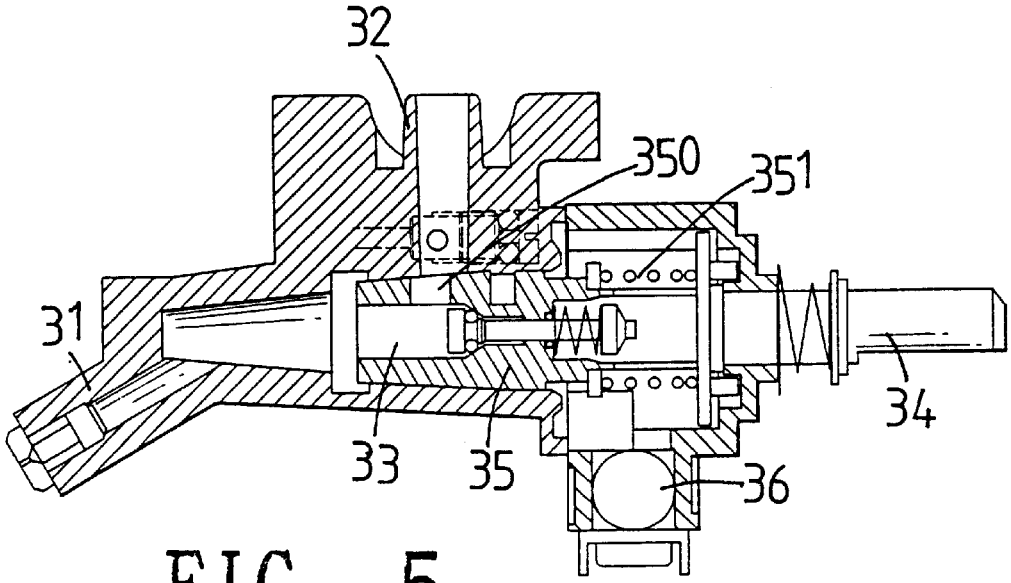
FIG. 5 is a side cross sectional view to show the gas burner of the present invention.

Referring to FIGS. 3 to 5, the gas burner of the present invention comprises a casing 30 having a chamber 33 defined therein and a valve 35 is received in the chamber 33. A spring 351 urges the valve 35 and an operation shaft 34 is rotatably inserted in the casing 30 and operatively connected to an ignition device 36. An orifice 350 is defined through a wall of the valve 35 and communicates between the inlet tube 32 and the chamber 33. An inlet tube 32 and an outlet tube 31 are respectively connected to the casing 30 and communicate with the chamber 33.

A receiving recess 43 is defined through the casing 30 and located perpendicular to an axis of the inlet tube 32. An opening 42 is defined in an outside of the casing 30 so that an adjusting screw 40 is rotatably received in the receiving recess 43 and users can access the head 44 of the screw 40 conveniently. The adjusting screw 40 has a threaded outer periphery which is threadedly engaged with a threaded inner periphery in the receiving recess 43.

A first passage 451 is defined in communication between the inlet tube 32 and the receiving recess 43. A second passage 452 is defined in communication with the receiving recess 43. A third passage 453 is defined in communication between the first passage 451 and the second passage 452. The passages 451, 452 and 453 are drilled from outside of the casing 30 so that the drilling is convenient. The openings that are formed due to the drill can be sealed by beads 46. The adjusting screw 40 is extended in a position that is in communication with the first passage 451 and the second passage 452.

The gas volume can be controlled by moving the adjusting screw 40 which controls the gap in communication between the first passage 451 and the second passage 452. The small amount of gas can be provided to keep a base flame for the gas burner so that the users need not to operate the ignition device often.

While we have shown and described the embodiment in accordance with the present invention, it should be clear to those skilled in the art that further embodiments may be made without departing from the scope of the present invention.

What is claimed is:

1. A gas burner comprising:

a casing having a chamber defined therein and a valve received in the chamber, a spring urging the valve and an operation shaft rotatably inserted in the casing and operatively connected to an ignition device, an orifice defined through a wall of the valve and communicating between the inlet tube and the chamber, an inlet tube and an outlet tube respectively connected to the casing and communicating with the chamber;

a receiving recess defined in the casing and located perpendicular to an axis of the inlet tube, an opening defined in an outside of the casing, a first passage defined in communication between the inlet tube and the receiving recess, a second passage defined in communication with the receiving recess, a third passage defined in communication between the first passage and the second passage, and an adjusting screw rotatably received in the receiving recess and extended in a position that is in communication with the first passage and the second passage.

2. The gas burner as claimed in claim 1 wherein the adjusting screw has a threaded outer periphery which is threadedly engaged with a threaded inner periphery in the receiving recess.

* * * * *